US008801220B2

(12) United States Patent
Chung

(10) Patent No.: US 8,801,220 B2
(45) Date of Patent: Aug. 12, 2014

(54) COLOR TEMPERATURE ADJUSTING DEVICE OF LIGHT SOURCE MODULE

(71) Applicant: Tintable Smart Material Co., Ltd., Tainan (TW)

(72) Inventor: Yi-Wen Chung, Tainan (TW)

(73) Assignee: Tintable Smart Material Co., Ltd., Tainan (TW)

( * ) Notice: Subject to any disclaimer, the term of this patent is extended or adjusted under 35 U.S.C. 154(b) by 0 days.

(21) Appl. No.: 13/648,381

(22) Filed: Oct. 10, 2012

(65) Prior Publication Data

US 2013/0314919 A1 Nov. 28, 2013

(30) Foreign Application Priority Data

May 23, 2012 (TW) ..... 101209764 A

(51) Int. Cl.
*F21V 1/00* (2006.01)

(52) U.S. Cl.
CPC ..... *F21V 1/00* (2013.01)
USPC ..... 362/236; 359/265

(58) Field of Classification Search
CPC ..... F21V 1/00; F21V 23/00
See application file for complete search history.

(56) References Cited

U.S. PATENT DOCUMENTS

| | | | | |
|---|---|---|---|---|
| 4,498,739 | A * | 2/1985 | Itaya et al. | 359/273 |
| 6,528,782 | B1 * | 3/2003 | Zhang et al. | 250/226 |
| 2004/0184282 | A1 * | 9/2004 | Nishijima et al. | 362/516 |
| 2007/0132371 | A1 * | 6/2007 | Liu | 313/504 |
| 2008/0239644 | A1 * | 10/2008 | Cassidy et al. | 361/681 |
| 2008/0246748 | A1 * | 10/2008 | Cassidy et al. | 345/205 |
| 2008/0252202 | A1 * | 10/2008 | Li et al. | 313/504 |
| 2012/0098007 | A1 * | 4/2012 | Kuo | 257/98 |

* cited by examiner

*Primary Examiner* — Mary Ellen Bowman
(74) *Attorney, Agent, or Firm* — Rosenberg, Klein & Lee

(57) ABSTRACT

A color temperature adjusting device of a light source module is revealed. The light source module includes at least one light source and at least one electrochromic device arranged at one side of the light source with a light emitting surface. The light source module is electrically connected to a control module. The control module consists of a light-source driver circuit and a control circuit for electrochromic devices that controls colored/bleached state of the electrochromic device. The light-source driver circuit is used to drive the light source to emit light. After passing through the electrochromic device, a light source is turned into a warm color light source or a cool color light source.

14 Claims, 5 Drawing Sheets

COLOR TEMPERATURE ADJUSTING DEVICE OF LIGHT SOURCE MODULE

BACKGROUND OF THE INVENTION

1. Fields of the invention

The present invention relates to a color temperature adjusting device, especially to a color temperature adjusting device of a light source module that changes color temperature of light sources by electrochromic devices.

2. Descriptions of Related Art

In some exhibitions, in order to show delicate work of items on display, each item is equipped with at least one spotlight. However, light emitted from the spotlight includes ultraviolet light. Thus the items on display are easy to fade in colors over time. Each item is a masterpiece or unique artifact for the owners. The color fading during the exhibition has negative effects on the values and texture of the items.

Thus staff of the exhibition will change light emitted from the spotlight according to the kinds and materials of the items on display. The method used now is to arrange a colored shield plate made from plastic in front of a light emitting surface of the spotlight. The color temperature of the spotlight can be modified by the colored shield plate. Once there is a need to change the color temperature of the spotlight, the colored shield plate is manually mounted and fixed on the side of the spotlight with the light emitting surface. Yet such operation is inconvenient in use. Especially when too many spotlights need to change the color temperature, the colored shield plates are mounted one after another. This is labor and time-consuming. Moreover, after the exhibition, the colored shield plates need to be removed one after another. This is quite troublesome.

SUMMARY OF THE INVENTION

Therefore it is a primary object of the present invention to provide a color temperature adjusting device of a light source module that selects electrochromic devices in warm colors or cool colors according to occasions the light source module applied. Thus a light source is switched to a warm color light source or a cold color light source by the electrochromic device in warm colors or cool colors. Thus a remote control of color temperature of at least one light source by the color temperature adjusting device of the present invention is achieved.

In order to achieve the above object, a color temperature adjusting device of a light source module according to the present invention includes a light source module and a control module. The light source module includes at least one light source and at least one electrochromic device arranged at one side of the light source with a light emitting surface. The light source module is electrically connected to the control module. The control module consists of a light-source driver circuit and a control circuit for electrochromic devices.

Thereby the coloration or bleaching of the electrochromic device is controlled by the control circuit for electrochromic devices of the control module. When the light-source driver circuit drives the light source to emit light, the light source is converted into a cool-color light source or a warm-color light source after the light emitted passing through the electrochromic device.

The color temperature adjusting device of a light source module further includes a central control unit, a plurality sets of control modules and a plurality sets of light source modules. Each set of the control module is electrically connected to a light source module correspondingly while the central control unit is electrically connected to the plurality sets of control modules. Thereby the central control unit controls the conversion of the plurality of light sources into cool-color light sources or warm-color light sources simultaneously.

The control circuit for electrochromic devices of the control module is built in the light-source driver circuit. The light source can be a light emitting diode (LED), an organic light emitting diode or a halogen lamp.

The electrochromic device is composed of a first module, a second module, an electrolyte layer, a first electrochromic layer, and a second electrochromic layer. The first module is formed by a first substrate and a first transparent electrode layer disposed over the first substrate while the second module consists of a second substrate and a second transparent electrode layer arranged over the second substrate. The second transparent electrode layer is symmetric to the first transparent electrode layer. The electrolyte layer for providing cations involved in electrochemical reactions is disposed between the first transparent electrode layer and the second transparent electrode layer. The first electrochromic layer is set between the electrolyte layer and the first transparent electrode layer. Moreover, a second electrochromic layer is further disposed between the electrolyte layer and the second transparent electrode layer.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
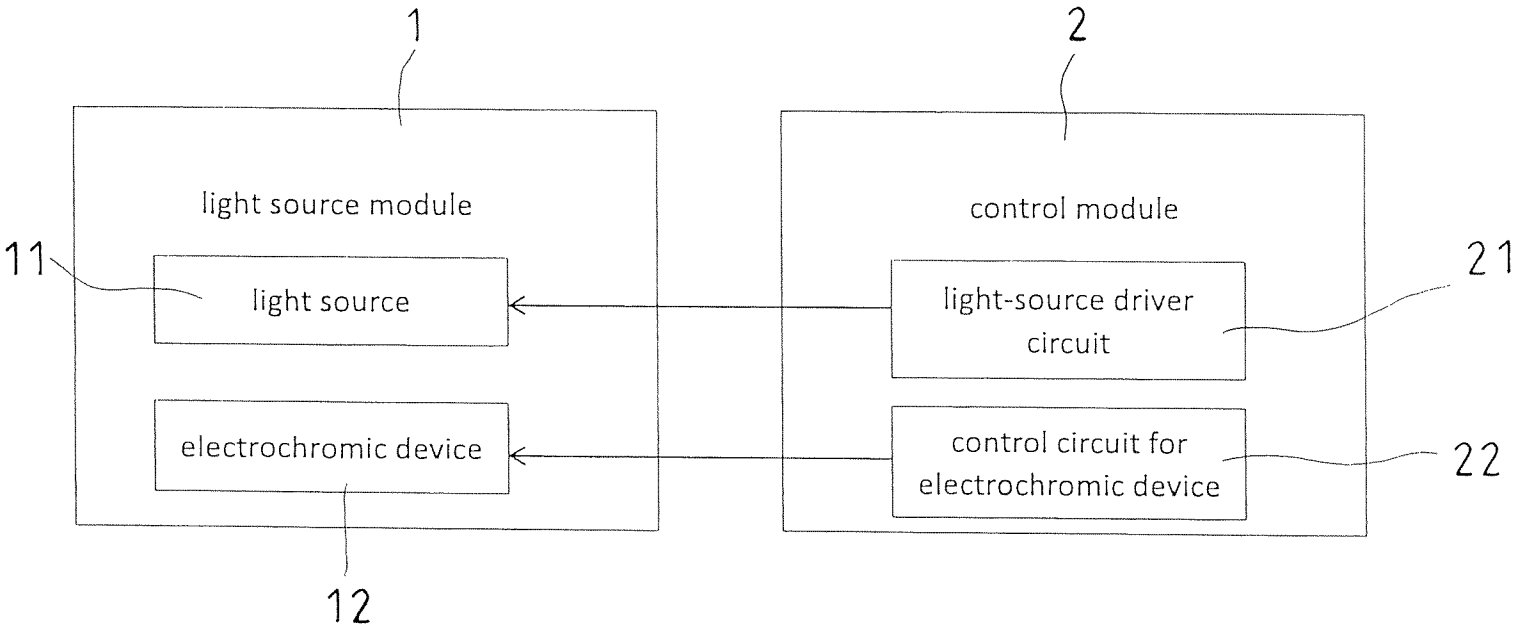
FIG. 1 is a block diagram showing structure of an embodiment of a color temperature adjusting device according to the present invention.

A color temperature adjusting device of a light source module according to the present invention mainly includes at least one light source module 1, at least one set of control module 2.

The light source module 1 includes at least one light source 11 and at least one electrochromic device 12 disposed on one side of the light source 11 with a light emitting surface. The electrochromic device 12 presents blue colors that are considered cool colors or yellow-brown colors that are considered warm colors. The control module 2 is electrically connected to the light source module 1. The control module 2 consists of a light-source driver circuit 21 that drives at least one light source 11 and a control circuit for electrochromic devices 22 that controls colored/bleached state of the electrochromic device 12.

Thereby the coloration or bleaching of the electrochromic device 12 with cool colors or warm colors is under control of the control circuit for electrochromic devices 22 of the control module 2. When the light-source driver circuit 21 drives the light source 11 to emit light, the light source 11 is converted into a cool-color light source or a warm-color light source after the light therefrom passing through the electrochromic device 12 in the colored or bleached state.

Figure 2:
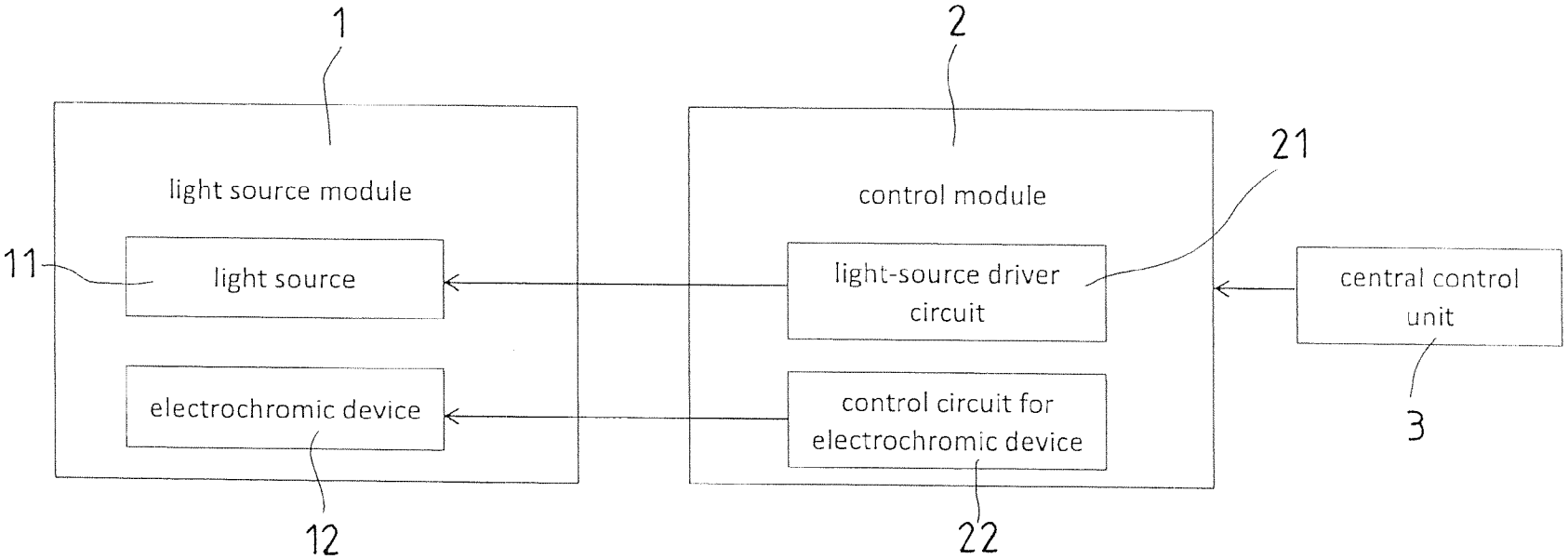
FIG. 2 is a block diagram showing structure of another embodiment of a color temperature adjusting device according to the present invention.

Refer to FIG. 2, another embodiment of the present invention further includes a central control unit 3 that is electrically connected to the control module 2. Thus the central control unit 3 controls the light source 11 and timing of coloration and bleaching of the electrochromic device 12 through the control module 2 so as to convert the light source 11 into the cool-color light source or the warm-color light source at remote end.

Figure 3:
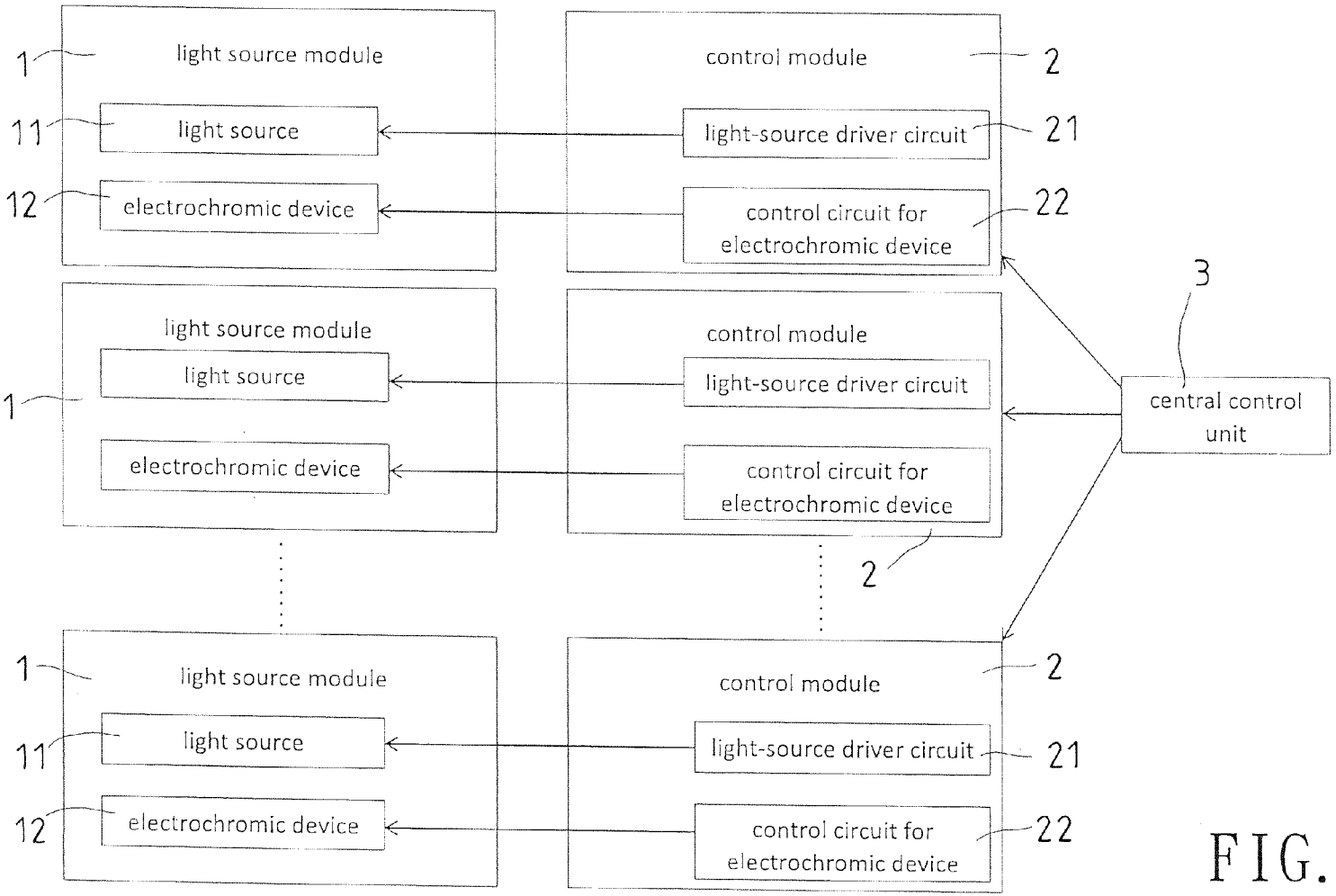
FIG. 3 is a block diagram showing structure of a further embodiment of a color temperature adjusting device according to the present invention.

Refer to FIG. 3, the color temperature adjusting device further includes a plurality sets of control modules 2 and a plurality sets of light source modules 1. Each set of the control module 2 is electrically connected to a light source module 1 correspondingly. As to the central control unit 3, it is electrically connected to the plurality sets of control modules 2. Thus the central control unit 3 can control the conversion of the plurality of light sources 11 into cool-color light sources or warm-color light sources simultaneously.

The control circuit for electrochromic devices 22 of the control module 2 can be built in the light-source driver circuit 21 or independent from the light-source driver circuit 21. The light source 11 can be a light emitting diode (LED), an organic light emitting diode or a halogen lamp.

Figure 4:
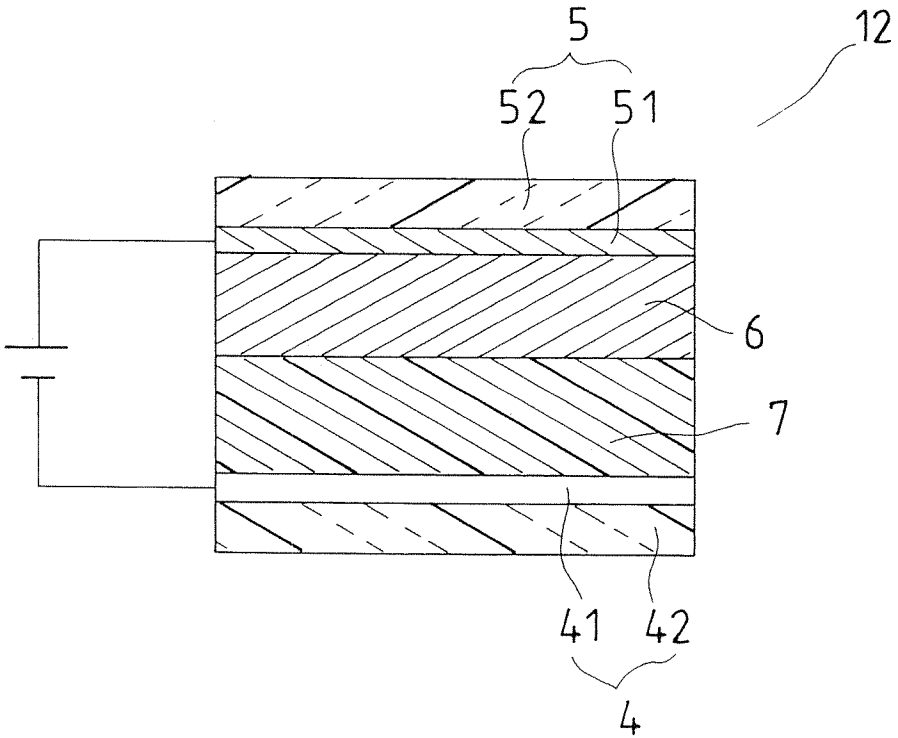
FIG. 4 is a cross section of an embodiment of an electrochromic device according to the present invention.

Refer to FIG. 4, a cross section of an embodiment of the electrochromic device 12 is revealed. The electrochromic device 12 mainly includes a first module 4, a second module 5, an electrolyte layer 6, and a first electrochromic layer 7. The first module 4 is formed by a first substrate 41 and a first transparent electrode layer 42 disposed over the first substrate 41. The second module 5 consists of a second substrate 51 and a second transparent electrode layer 52 arranged over the second substrate 51. The position of the second transparent electrode layer 52 is symmetric to that of the first transparent electrode layer 42. The first substrate 41 and the second substrate 51 respectively can be a transparent plastic substrate or a glass substrate. The transparent plastic substrate can be a polycarbonate (PC) substrate, a polyethylene terephthalate (PET) substrate, a polymethyl methacrylate (PMMA) substrate, a polyvinylidene difluoride (PVDF) substrate, a polyvinyl chloride (PVC) substrate or a polyethylene oxide (PEO) substrate. The first transparent electrode layer 42 and the second transparent electrode layer 52 are made from following materials: indium tin oxide (ITO), fluorine-doped tin oxide (FTO), aluminum zinc oxide (AZO), gallium doped zinc oxide (GZO), carbon nanomaterials, conducting polymers and conductive metals. The electrolyte layer 6 is disposed between the first transparent electrode layer 42 and the second transparent electrode layer 52 and is used to provide cations involved in (participated in) electrochemical reactions. The cations are group IA metal ions such as $H^+$, $Li^+$, $Na^+$, $K^+$, etc. The first electrochromic layer 7 is arranged between the electrolyte layer 6 and the first transparent electrode layer 42. The material for the first electrochromic layer 7 is selected from the group consisting of transition metal oxides (such as tungsten oxide $WO_3$, nickel oxide $NiO_X$, vanadium oxide $V_2O_5$, copper oxide $CuO_x$, etc.), intercalated materials (such as iron hexacyanoferrate $Fe_4[Fe(CN)_6]_3$), and organic compounds (such as poly(aniline), viologen, etc).

In an embodiment, the first electrochromic layer 7 is made from tungsten oxide and the electrolyte layer 6 provides $Li^+$ cations involved in the electrochemical reactions. Then an external voltage is applied between the first transparent electrode layer 42 and the second transparent electrode layer 52. Both cations $Li^+$ and electrons $e^-$ enter the first electrochromic layer 7 at the same time so that reduction of the tungsten oxide of the first electrochromic layer 7 occurs and a deep-blue reduction state $Li_xW_{IV(1-x)}W_{Vx}O_3$ is formed. This is coloration and the chemical equation is as following:

$$WO_3+x(Li^++e^-)\rightarrow Li_xW_{IV(1-x)}W_{Vx}O_3.$$

When the voltage applied is removed or when the voltage polarity is reversed, cations $Li^+$ and electrons $e^-$ leave the first electrochromic layer 7 simultaneously so that oxidation of $Li_xW_{IV(1-x)}W_{Vx}O_3$ of the first electrochromic layer 7 occurs and a transparent oxidation state tungstic oxide $W_{Vx}O_3$ is obtained. This is discoloration and the chemical equation is as following:

$$Li_xW_{IV(1-x)}W_{Vx}O_3\rightarrow WO_3+x(Li^++e^-).$$

Figure 5:
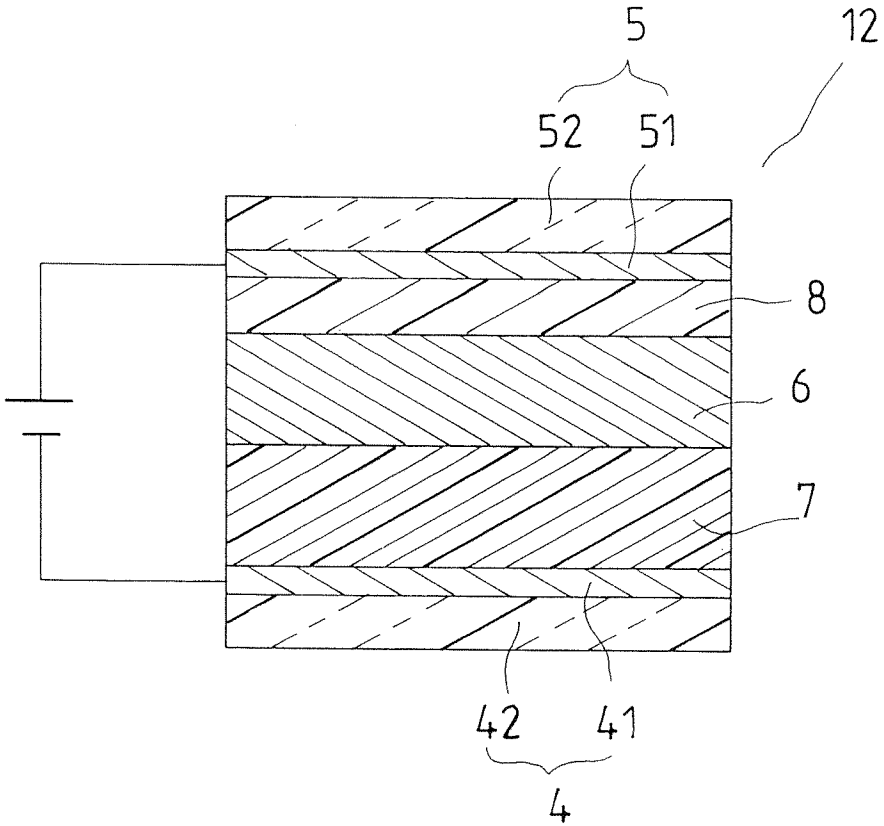
FIG. 5 is a cross section of another embodiment of an electrochromic device according to the present invention.

Refer to FIG. 5, another embodiment of the electrochromic device 12 is revealed. The difference between this embodiment and the above one is in that this embodiment further includes a second electrochromic layer 8 disposed between the electrolyte layer 6 and the second transparent electrode layer 52. The material for the second electrochromic layer 8 is selected from the followings: transition metal oxides (such as tungsten oxide, nickel oxide, vanadium oxide, copper oxide, etc.), Intercalated materials (such as iron hexacyanoferrate), and organic compounds (such as poly(aniline), viologen, etc).

In the above embodiment, the electrochromic device 12 switches between the first color system and the second color system due to disposition of the second electrochromic layer 8 so as to meet requirements of practical use. In contrast, the electrochromic device of the first embodiment changes between transparency and the first color system.

By changing materials of the first electrochromic layer 7 and the second electrochromic layer 8 of the electrochromic device 12, the electrochromic device 12 presents a transparent color, primary colors, cool colors or warm colors in colored or bleached state.

For example, if the electrochromic device 12 only includes the first electrochromic layer 7 made from Prussian blue or tungsten oxide, the electrochromic device 12 shows cool colors such as deep-blue during the coloration process. When light from a warm color light source 11 passes through the electrochromic device 12 in the colored state, a light source in cool colors is obtained. Once the first electrochromic layer 7 is made from nickel oxide, the electrochromic device 12 presents warm colors such as yellow-brown color in the colored state. When light from a cool color light source 11 passes through the electrochromic device 12 in the colored state, a warm color light source in is obtained.

Once the electrochromic device 12 includes both the first electrochromic layer 7 and the second electrochromic layer 8, respectively made from Prussian blue/or tungsten oxide and nickel oxide, the electrochromic device 12 shows cool colors such as deep-blue during the coloration process. When light from a light source 11 passes through the electrochromic device 12 in the colored state, a light source in cool colors is obtained. The electrochromic device 12 presents warm colors such as yellow-brown color during discoloration in the bleached state. When light from the light source 11 passes through the electrochromic device 12 in the bleached state, a warm color light source in is obtained Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A color temperature adjusting device of a light source module comprising:

a plurality of light source modules, each light source module having at least one light source and at least one electrochromic device disposed at one side of the light source with a light emitting surface, the electrochromic device switches between two color systems in colored/bleaching state and the two color systems are selected from the group consisting of cool colors and primary colors, warm colors and primary colors, and cool colors and warm colors;

a plurality of control modules, each control module electrically connected to a corresponding one of the light source modules, each control module having at least one light-source driver circuit that drives at least one of the light sources; and at least one control circuit for electrochromic devices that controls the colored/bleached state of the electrochromic device; and a central control unit electrically connected to each of the control modules, the central control unit selectively controlling the control modules simultaneously and independently to generate a unique combined color temperature response, each of said electrochromic devices includes: a first module having a first substrate and a first transparent electrode layer disposed over the first substrate; a second module having a second substrate and a second transparent electrode layer arranged over the second substrate while the second transparent electrode layer is symmetric to the first transparent electrode layer; at least one electrolyte layer that is disposed between the first transparent electrode layer and the second transparent electrode layer and is for providing cations involved in electrochemical reactions; and at least one electrochromic layer set between the electrolyte layer and the first transparent electrode layer, said electrochromic layer is formed from a material selected from the group consisting of a transition metal oxide, hexacyanoferrate ($Fe_4[Fe(CN)_6]_3$), and an organic compound.

2. The device as claimed in claim 1, wherein the control circuit for electrochromic devices is built in the light-source driver circuit.

3. The device as claimed in claim 1, wherein the light source is selected from the group consisting of a halogen lamp, a light emitting diode (LED) or an organic light emitting diode (OLED).

4. The device as claimed in claim 1, wherein a second electrochromic layer is disposed between the electrolyte layer and the second transparent electrode layer.

5. The device as claimed in claim 4, wherein the second electrochromic layer is made from material selected from the group consisting of a transition metal oxide, an intercalated material, and an organic compound.

6. The device as claimed in claim 5, wherein the transition metal oxide is selected from the group consisting of tungsten oxide (WO.sub.3), nickel oxide ($NiO_x$), vanadium oxide ($V_2O_5$), and copper oxide ($CuO_x$).

7. The device as claimed in claim 5, wherein the intercalated material is iron hexacyanoferrate ($Fe_4[Fe(CN)_6]_3$).

8. The device as claimed in claim 5, wherein the organic compound is poly(aniline) or viologen.

9. The device as claimed in claim 1, wherein the first substrate and the second substrate respectively are a transparent plastic substrate or a glass substrate.

10. The device as claimed in claim 9, wherein the transparent plastic substrate is selected from the group consisting of a polycarbonate (PC) substrate, a polyethylene terephthalate (PET) substrate, a polymethyl methacrylate (PMMA) substrate, a polyvinylidene difluoride (PVDF) substrate, a polyvinyl chloride (PVC) substrate or a polyethylene oxide (PEO) substrate.

11. The device as claimed in claim 1, wherein material for the first transparent electrode layer and for the second transparent electrode layer respectively is selected from the group consisting of indium tin oxide (ITO), fluorine-doped tin oxide (FTO), aluminum zinc oxide (AZO), gallium doped zinc oxide (GZO), carbon nanomaterials, conducting polymers and conductive metals.

12. The device as claimed in claim 1, wherein the transition metal oxide is selected from the group consisting of tungsten oxide ($W0_3$), nickel oxide ($NiO_x$), vanadium oxide ($V_2O_5$), and copper oxide ($CuO_x$).

13. The device as claimed in claim 1, wherein the organic compound is poly(aniline) or viologen.

14. The device as claimed in claim 1, wherein the cations are group IA metal ions.

* * * * *